US006766559B2

(12) United States Patent
Roney et al.

(10) Patent No.: US 6,766,559 B2
(45) Date of Patent: Jul. 27, 2004

(54) TELESCOPING HANDLE FOR UPRIGHT VACUUM CLEANER

(75) Inventors: Jeffrey T. Roney, Stanford, KY (US); James T. Crouch, Danville, KY (US)

(73) Assignee: Matsushita Electric Corporation of America, Secaucus, NJ (US)

( * ) Notice: Subject to any disclaimer, the term of this patent is extended or adjusted under 35 U.S.C. 154(b) by 317 days.

(21) Appl. No.: 10/091,292

(22) Filed: Mar. 5, 2002

(65) Prior Publication Data

US 2002/0124347 A1 Sep. 12, 2002

Related U.S. Application Data

(60) Provisional application No. 60/275,064, filed on Mar. 12, 2001.

(51) Int. Cl.[7] ..... A47L 9/00; A47L 9/32; A47L 5/00; A45F 5/10

(52) U.S. Cl. ..... 15/410; 15/363; 15/DIG. 10; 16/429

(58) Field of Search ..... 15/410, DIG. 10, 15/363, 143.1, 144.1, 351; 55/DIG. 3; 285/7, 302; 16/429, 144.1

(56) References Cited

U.S. PATENT DOCUMENTS

| | | | |
|---|---|---|---|
| 1,365,851 | A | 1/1921 | Reynolds |
| 1,918,519 | A | 7/1933 | Clements |
| 1,936,366 | A | 11/1933 | Riebel, Jr. et al. |
| 2,177,969 | A | 10/1939 | Welles et al. |
| 2,546,387 | A | 3/1951 | Coffing |
| 2,641,012 | A | 6/1953 | Storrs |
| 2,660,457 | A | 11/1953 | Mallon |
| 3,273,194 | A | 9/1966 | Jepson et al. |
| 3,351,363 | A | 11/1967 | Downey et al. |
| 4,114,927 | A | 9/1978 | Butcher |
| 4,155,143 | A | 5/1979 | Garbe |
| 4,247,216 | A | 1/1981 | Pansini |
| 4,662,026 | A | 5/1987 | Sumerau et al. |
| 4,766,638 | A | 8/1988 | McDowell |
| 4,793,646 | A | 12/1988 | Michaud, Jr. |
| 4,989,295 | A | 2/1991 | Guhne et al. |
| 5,332,266 | A | 7/1994 | Canale |
| 5,568,943 | A | 10/1996 | Kilstrom et al. |
| 5,692,782 | A | 12/1997 | Fischer |
| 5,867,862 | A | 2/1999 | Ahlf et al. |
| 5,920,944 | A | 7/1999 | Biggs et al. |
| 5,941,575 | A | 8/1999 | Herbst |
| 6,052,864 | A | 4/2000 | Ho |
| 6,158,089 | A | 12/2000 | Monahan et al. |

FOREIGN PATENT DOCUMENTS

| | | | |
|---|---|---|---|
| GB | 2 220 163 | A | 1/1990 |

*Primary Examiner*—Robert J. Warden, Sr.
*Assistant Examiner*—Laura C Cole
(74) *Attorney, Agent, or Firm*—King & Schickli, PLLC

(57) ABSTRACT

An upright vacuum cleaner includes a nozzle assembly and a canister assembly pivotally connected to the nozzle assembly. A suction generator is carried on one of the nozzle assembly or the canister assembly. The upright vacuum cleaner also includes a telescoping handle assembly including an elongated handle received in a slot for sliding movement relative to the canister assembly, a projecting guide pin carried on the elongated handle, a cooperating guide channel in the canister assembly for receiving the guide pin and a latch carried on the canister assembly for selectively engaging any one of the longitudinally spaced apertures formed in the elongated handle.

18 Claims, 3 Drawing Sheets

20
10
18
32
22
12
16
46
46
35
34
14
30
38a
36
38b

TELESCOPING HANDLE FOR UPRIGHT VACUUM CLEANER

This application claims the benefit of U.S. Provisional Patent Application No. 60/275,064, filed Mar. 12, 2001.

TECHNICAL FIELD

The present invention relates generally to the vacuum cleaner field, and, more particularly, to a telescoping handle for an upright vacuum cleaner and an upright vacuum cleaner incorporating such a telescoping handle.

BACKGROUND OF THE INVENTION

Upright vacuum cleaners in all of their designs and permutations have become increasingly popular over the years. The upright vacuum cleaners generally incorporate a nozzle assembly and a canister assembly pivotally connected to the nozzle assembly. Together, the two assemblies ride on wheels over the floor surface to be cleaned.

The canister assembly includes an operating handle that is manipulated by the user to move the vacuum cleaner to and fro across the floor. The canister assembly also includes either a bag-like filter or a cyclonic separation chamber and filter combination that traps dirt and debris while substantially clean air is exhausted by a fan that is driven by an onboard electric motor. It is this fan and motor arrangement that generates the drop in air pressure necessary to provide the desired cleaning action. In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

In order for the operator to be able to comfortably manipulate and easily control the movement of the vacuum cleaner back and forth across the floor, it is important for the control handle to be a particular height or length. That height or length varies depending upon the height of the operator. Accordingly, the best upright vacuum cleaners incorporate a control handle that is adjustable in length. Such a handle may also be fully retracted when the vacuum cleaner is in the upright storage position. This allows more convenient storage of the vacuum cleaner in a closet or the like when not in use. The present invention relates to a simple and inexpensive telescoping handle design that provides user-friendly and reliable performance over a long service life.

SUMMARY OF THE INVENTION

In accordance with the purposes of the present invention as described herein, an improved upright vacuum cleaner is provided. That upright vacuum cleaner includes a nozzle assembly and a canister assembly pivotally connected to the nozzle assembly. Additionally, a suction generator is carried on the nozzle assembly or the canister assembly.

The upright vacuum cleaner also includes a telescoping handle assembly. The telescoping handle assembly includes an elongated handle received in a slot in the canister assembly for sliding movement relative to the canister assembly. The elongated handle also includes a series of longitudinally spaced adjustment apertures. The telescoping handle assembly still further includes a projecting guide pin carried on the elongated handle and a cooperating guide channel on the canister assembly for receiving the projecting guide pin. Additionally, the telescoping handle assembly includes a latch carried on the canister assembly for selectively engaging any one of the longitudinally spaced adjustment apertures.

Still more specifically describing the invention, the elongated handle includes a lumen and a guide pin receiving aperture. A spring clip is secured to the projecting guide pin. The spring clip is received in the lumen to hold the projecting guide pin in place in the guide pin receiving aperture.

The latch is pivotally mounted to the canister assembly. A compression spring biases a pin on the latch into selective engagement with any one of the longitudinally spaced adjustment apertures. The latch may be L-shaped. Additionally, a hand grip may be provided on the control handle to allow easier manipulation of the vacuum cleaner and more user friendly operation.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present invention, an example of which is illustrated in the accompanying drawing.

DETAILED DESCRIPTION OF THE INVENTION

Figure 1:
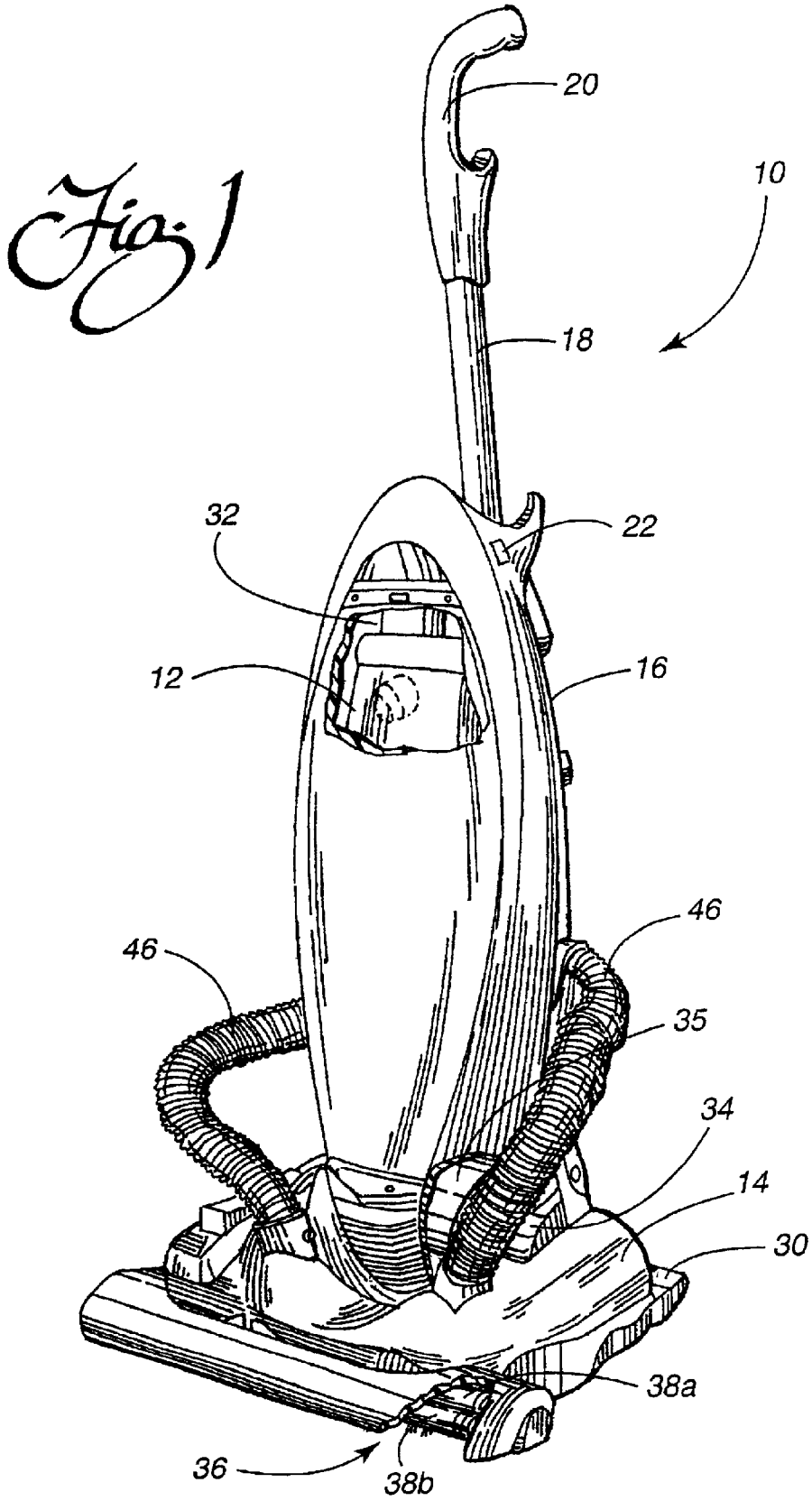
FIG. 1 is a perspective view of an upright vacuum cleaner of the present invention.

Reference is now made to FIG. 1 showing the upright vacuum cleaner 10 of the present invention. The upright vacuum cleaner 10 includes a nozzle assembly 14 and a canister assembly 16. The canister assembly 16 further includes a control handle 18 and a hand grip 20. The canister assembly 16 carries a control switch 22 for turning the vacuum cleaner on and off. Of course, electrical power is supplied to the vacuum cleaner 10 from a standard electrical wall outlet through a cord (not shown).

At the lower portion of the nozzle and canister assemblies 14, 16 wheels (not shown) are provided to support the weight of the vacuum cleaner 10. To allow for convenient storage of the vacuum cleaner 10, a foot latch 30 functions to lock the canister assembly 16 in an upright position as shown in FIG. 1. When the foot latch 30 is released, the canister assembly 16 may be pivoted relative to the nozzle assembly 14 as the vacuum cleaner 10 is manipulated to-and-fro to clean the floor.

The canister assembly 16 includes a cavity 32 adapted to receive and hold a dust bag 12. Alternatively, the vacuum cleaner 10 could be equipped with a dust collection cup such as found on cyclonic type models if desired. Additionally, the canister assembly 16 carries a suction fan 34 and suction fan drive motor 35. Together, the suction fan 34 and its cooperating drive motor 35 function to generate a vacuum airstream for drawing dirt and debris from the surface to be cleaned. While the suction fan 34 and suction fan drive motor 35 are illustrated as being carried on the canister assembly 16, it should be appreciated that they could likewise be carried on the nozzle assembly 14 if desired.

The nozzle assembly 14 includes a nozzle and agitator cavity 36 that houses a pair of rotating agitator brushes 38*a* and 38*b*. The agitator brushes 38*a* and 38*b* shown are rotatably driven by the drive motor 35 through a cooperating belt and gear drive system. In the illustrated vacuum cleaner 10, the scrubbing action of the rotary agitator brushes 38*a*, 38*b* and the negative air pressure created by the suction fan 34 and drive motor 35 cooperate to brush and beat dirt and dust from the nap of the carpet being cleaned and then draw the dirt and dust laden air from the agitator cavity 36 to the dust bag 12. Specifically, the dirt and dust laden air passes serially through the hoses 46 and/or an integrally molded conduit in the nozzle assembly 14 and/or canister assembly 16 as is known in the art. Next, it is delivered into the dust bag 12 which serves to trap the suspended dirt, dust and other particles inside while allowing the now clean air to pass freely through to the suction fan 34, a final filtration cartridge and ultimately to the environment through the exhaust port (not shown).

Figures 2, 4:
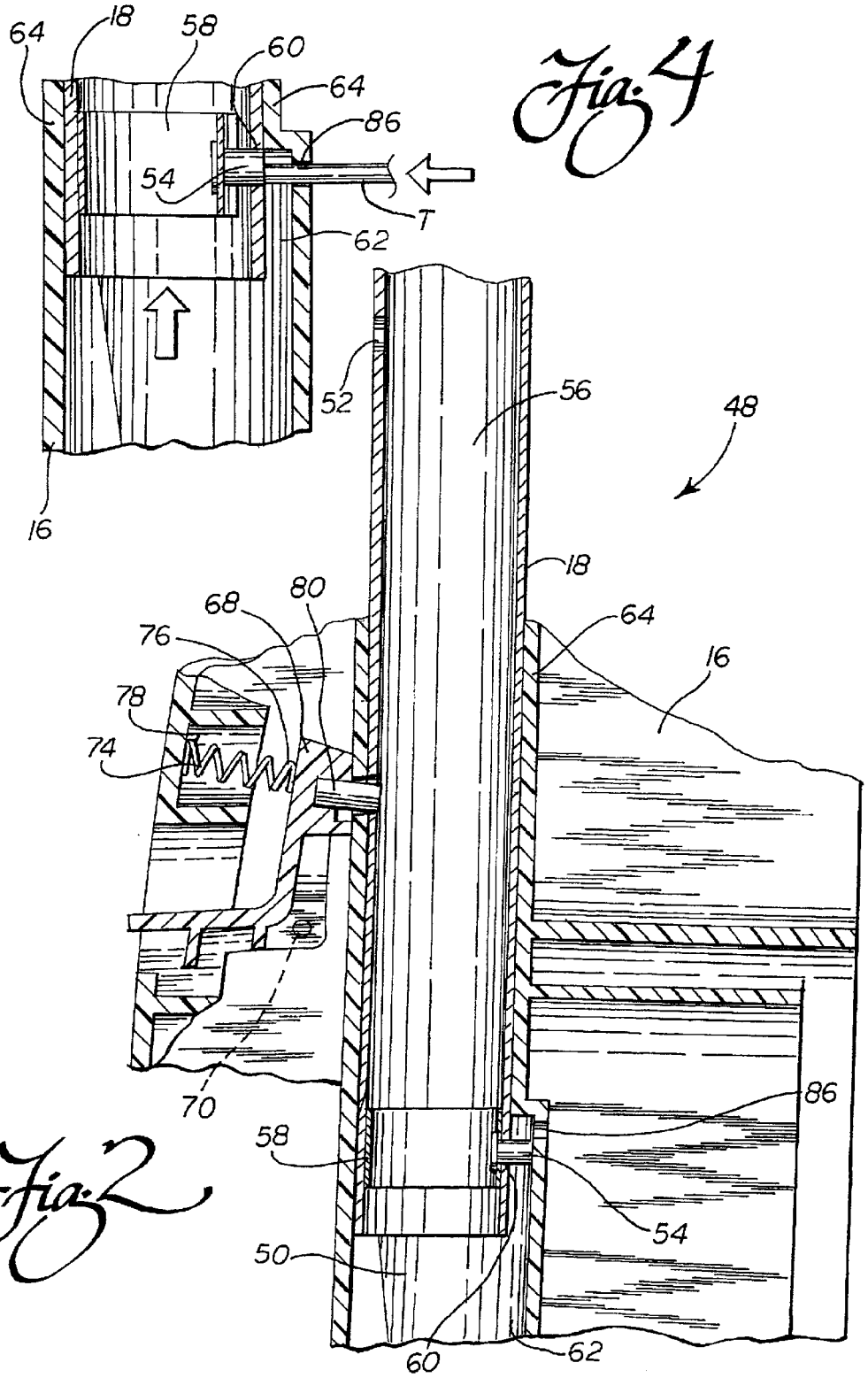
FIG. 2 is a detailed, cross-sectional view of the telescoping handle assembly showing the pin on the latch engaged in one of the adjustment apertures in the handle.
FIG. 4 is a detailed view similar to FIG. 3 illustrating how one releases the handle for removal from the canister assembly.
Figure 3:
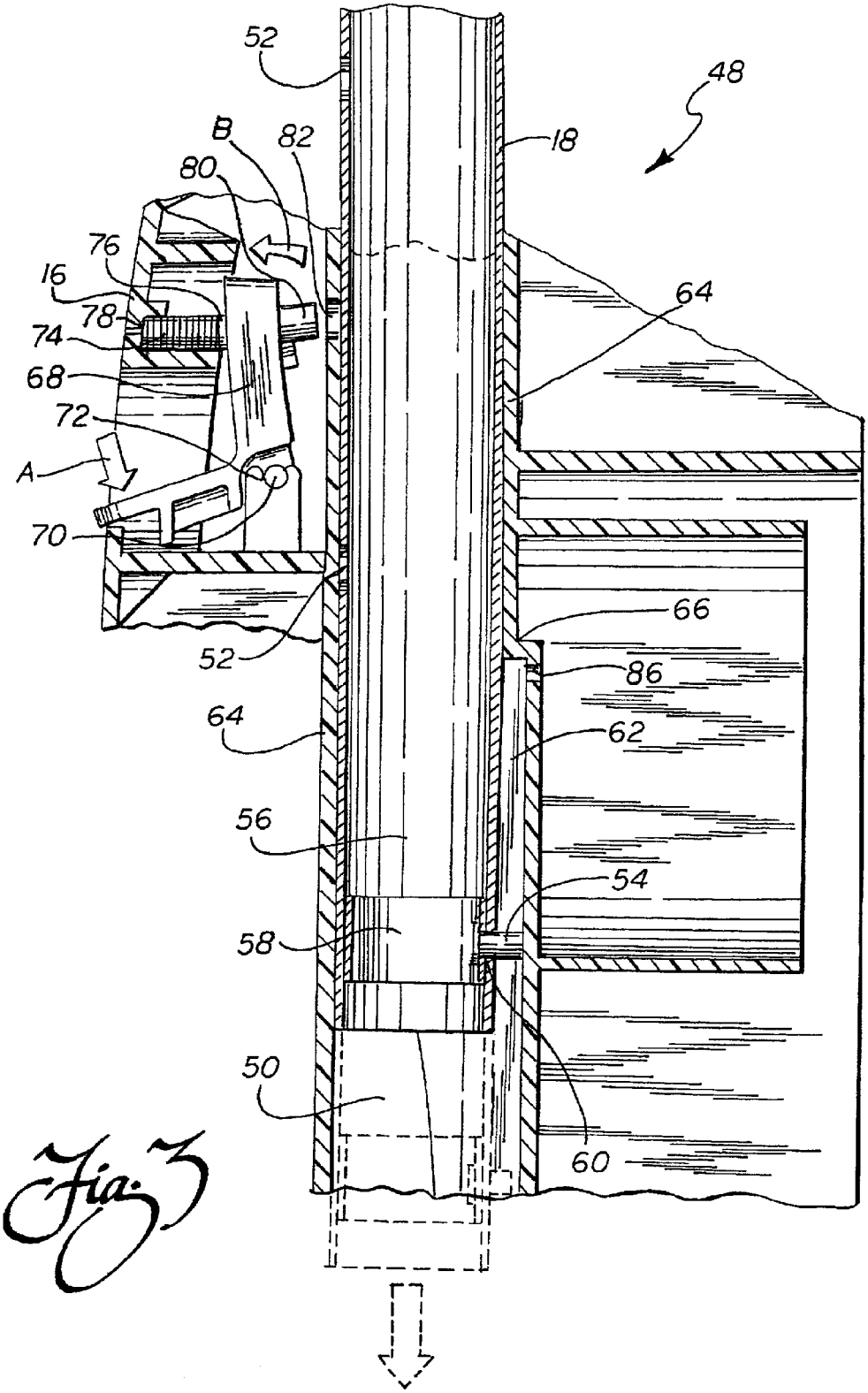
FIG. 3 is a detailed, cross-sectional view similar to FIG. 2 showing the latch pin disengaged from the adjustment apertures in the handle to allow selective telescoping movement of the handle.

The telescoping handle assembly, generally designated by reference numeral 48, is best shown with reference to FIGS. 2–4. As shown in FIG. 2, the control handle 18 is received in a slot 50 formed in the canister assembly 16. Sufficient clearance is provided between the handle 18 and the wall 64 of the slot 50 to allow free sliding movement of the handle in the canister assembly 16.

As further shown in FIGS. 2 and 3, the elongated handle 18 includes a series of longitudinally spaced adjustment apertures 52. While only two adjustment apertures 52 are shown in the drawing figures, it should be appreciated that substantially any appropriate number of longitudinally spaced adjustment apertures 52 may be provided along the handle 18, spaced at increments to allow the selective adjustment of the length of the telescoping handle.

As further shown, a projecting guide pin 54 is carried on the elongated handle 18. More specifically, the elongated handle 18 includes a lumen 56. A spring clip 58 is welded or otherwise secured to the guide pin 54. Spring clip 58 is positioned in the lumen 56 of the handle 18 with the guide pin 54 projecting outwardly from the handle through a guide pin receiving aperture 60. The outwardly exerted biasing force of the spring clip 58 against the wall of the handle 18 insures the integrity of the connection.

A guide channel 62 is formed in the wall 64 of the canister assembly 16 forming the slot 50. The guide channel 62 is in communication with the slot 50 and functions to receive the portion of the guide pin 54 projecting through the handle 18. As should be appreciated from reviewing FIG. 4, engagement of the guide pin 54 with the upper shoulder 66 of the guide channel 62 prevents the telescoping handle 18 from being inadvertently removed from the slot 50 in the canister assembly 16.

A substantially L-shaped latch 68 is carried on the canister assembly 16 for selectively engaging any one of the longitudinally spaced adjustment apertures 52. As illustrated, the latch 68 includes a pair of opposed, integrally molded pivot pins 70 (only one shown in the drawing figures) that share a common axis. The pivot pins 70 are received in cooperating notches 72 formed on the canister assembly 16 so that the latch 68 pivots with respect to the canister assembly. A compression spring 74 has a first end engaged on a tab 76 carried adjacent one end of the latch 68 and a second end that engages in a socket 78 formed in the canister assembly 16. The spring 74 serves to bias the latch 68 in a clockwise direction as shown in FIGS. 2 and 3 so that the latch pin 80 projects through the aperture 82 in the wall 64 of the canister assembly 16 forming the slot 50. Thus, the latch pin 80 engages in any adjustment aperture 52 brought into alignment with the latch pin 80 as the handle 18 is moved in a telescoping manner into or out of the canister assembly 16. When alignment occurs between the latch pin 80 and one of the adjustment apertures 52, the spring 74 immediately biases the latch pin into the adjustment aperture (note FIG. 3). This engagement functions to lock the handle 18 in a selected telescoping position.

A different position may be easily selected by pressing downwardly (note action arrow A in FIG. 2) on the exposed end of the latch 68. This causes the latch 68 to pivot about the pivot pins 70 against the force of the spring 74 in a counterclockwise direction (note action arrow B) as shown in the drawing figures. This functions to withdraw the latch pin 80 from the adjustment aperture 52 thereby freeing the handle 18 for telescoping movement to a different desired position. The latch 68 is then released. Upon reaching the new position, the spring 74 again functions to bias the latch pin 80 into the new adjustment aperture 52 aligned therewith (again see FIG. 3). In this way the operator may adjust the handle to a desired length to allow comfortable control and manipulation of the upright vacuum cleaner 10 without the necessity of stooping or bending awkwardly at the waist.

In certain situations, it may be desirable to be able to remove the handle 18 from the canister assembly 16. Accordingly, it must be possible to defeat the operation of the guide pin 54, which as noted above, also functions to prevent the inadvertent removal of the handle 18 from the canister assembly 16. Toward that end, an access aperture 86 is formed in the wall 64 adjacent the shoulder 66. When the guide pin 54 engages the shoulder 66, the end of the guide pin is aligned with the access aperture 86. By inserting the end of a small tool such as a punch or paper clip T into the access aperture 86, it is possible in this position to depress the guide pin 54 back into the lumen 56 of the handle 18 against the spring clip 58 until the guide pin 54 clears the shoulder 66. The handle 18 may then be freely withdrawn through the slot 50 and removed from the canister assembly 16. The handle 18 may be replaced in the canister assembly 16 when desired by depressing the guide pin 54 into the lumen 56 and inserting the handle 18 into the slot 50. The wall 64 of the slot 50 holds the guide pin 54 in the depressed position until the guide pin 54 is again aligned with the channel 62. At that point the spring clip 58 biases the guide pin 54 outwardly again into the channel 62 so that the handle 18 is again secured against inadvertent removal from the canister assembly 16.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, while a vacuum cleaner 10 with dual agitators 38*a*, 38*b* is illustrated, the invention is equally applicable to vacuum cleaners equipped with a greater or lesser number. Further, while the embodiment illustrated and described in detail includes a guide pin carried on the handle and a cooperating guide pin receiving channel carried on the canister assembly, the location of these cooperating structures could be reversed if desired and still provide the same function.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An upright vacuum cleaner, comprising:

a nozzle assembly;

a canister assembly pivotally connected to said nozzle assembly, said canister assembly including a slot;

a suction generator carried on one of said nozzle assembly and said canister assembly; and a telescoping handle assembly including;

(a) an elongated handle received in said slot for sliding movement relative to said canister assembly, said elongated handle including a series of longitudinally spaced adjustment apertures;

(b) a projecting guide pin carried on said elongated handle;

(c) a cooperating guide channel for receiving said projecting guide pin, said cooperating guide channel being connected to said canister assembly; and (d) a latch connected to said canister assembly for selectively engaging any one of said longitudinally spaced adjustment apertures.

2. The upright vacuum cleaner of claim 1, wherein said elongated handle includes a lumen and a guide pin receiving aperture.

3. The upright vacuum cleaner of claim 2, further including a spring clip secured to said projecting guide pin, said spring clip being received in said lumen to hold said projecting guide pin in place in said guide pin receiving aperture.

4. The upright vacuum cleaner of claim 1, wherein said latch is pivotally mounted to said canister assembly.

5. The upright vacuum cleaner of claim 4, further including a compression spring for biasing said latch into selective engagement with any one of said longitudinally spaced adjustment apertures.

6. The upright vacuum cleaner of claim 5, wherein said latch is L-shaped.

7. The upright vacuum cleaner of claim 1, further including a hand grip carried on said handle.

8. The upright vacuum cleaner of claim 1, further including a shoulder at an end of said guide channel which engages said projecting guide pin and prevents inadvertent removal of said elongated handle from said canister assembly.

9. The upright vacuum cleaner of claim 8, further including an access aperture in a wall of said canister assembly defining said channel, said access aperture being adjacent said shoulder and allowing one to depress said projecting guide pin and release said elongated handle for removal from said canister assembly.

10. An upright vacuum cleaner, comprising:

a nozzle assembly;

a canister assembly pivotally connected to said nozzle assembly, said canister assembly including a slot;

a suction generator carried on one of said nozzle assembly and said canister assembly; and a telescoping handle assembly including:

(a) an elongated handle received in said slot for sliding movement relative to said canister assembly, said elongated handle including a series of longitudinally spaced adjustment apertures;

(b) a projecting guide pin carried upon one of said elongated handle and said canister assembly;

(c) a cooperating guide channel for receiving said projecting guide pin, said guide channel being carried on the other of said handle and said canister assembly; and (d) a latch carried on said canister assembly for selectively engaging any one of said longitudinally spaced adjustment apertures.

11. The upright vacuum cleaner of claim 10, wherein said elongated handle includes a lumen and a guide pin receiving aperture.

12. The upright vacuum cleaner of claim 11, further including a spring clip secured to said projecting guide pin, said spring clip being received in said lumen to hold said projecting guide pin in place in said guide pin receiving aperture.

13. The upright vacuum cleaner of claim 10, wherein said latch is pivotally mounted to said canister assembly.

14. The upright vacuum cleaner of claim 13, further including a compression spring for biasing said latch into selective engagement with any one of said longitudinally spaced adjustment apertures.

15. The upright vacuum cleaner of claim 14, wherein said latch is L-shaped.

16. The upright vacuum cleaner of claim 10, further including a hand grip carried on said handle.

17. The upright vacuum cleaner of claim 10, further including a shoulder at an end of said guide channel which engages said projecting guide pin and prevents inadvertent removal of said elongated handle from said canister assembly.

18. The upright vacuum cleaner of claim 17, further including an access aperture in a wall of said canister assembly defining said channel, said access aperture being adjacent said shoulder and allowing one to depress said projecting guide pin and release said elongated handle for removal from said canister assembly.

* * * * *